US006753494B2

(12) United States Patent
Asakawa et al.

(10) Patent No.: US 6,753,494 B2
(45) Date of Patent: Jun. 22, 2004

(54) SINTERED BODY AND ELECTRODE, METHOD FOR SURFACE DENSITICATION OF THESE, PROCESS FOR MANUFACTURING ELECTRODE BY THIS METHOD AND CIRCUIT BREAKER

(75) Inventors: Yohei Asakawa, Yokohama (JP); Hideaki Onozuka, Sagamihara (JP); Motohiro Kikuchi, Hitachi (JP); Yoshio Koguchi, Hitachiota (JP); Masato Kobayashi, Hitachi (JP); Masaya Takahashi, Hitachi (JP); Shigeru Kikuchi, Tokai (JP)

(73) Assignee: Hitachi, Ltd., Tokyo (JP)

( * ) Notice: Subject to any disclaimer, the term of this patent is extended or adjusted under 35 U.S.C. 154(b) by 1 day.

(21) Appl. No.: 10/118,171

(22) Filed: Apr. 9, 2002

(65) Prior Publication Data

US 2003/0015500 A1 Jan. 23, 2003

(30) Foreign Application Priority Data

Jul. 17, 2001 (JP) ..... 2001-216589

(51) Int. Cl.[7] ..... H01H 33/66
(52) U.S. Cl. ..... 218/130
(58) Field of Search ..... 218/118–133, 10, 218/16–21, 146; 75/243–247; 200/264–266

(56) References Cited

U.S. PATENT DOCUMENTS

| | | | | | |
|---|---|---|---|---|---|
| 5,612,523 | A | * | 3/1997 | Hakamata et al. | 218/132 |
| 5,691,521 | A | * | 11/1997 | Komuro et al. | 218/123 |
| 5,697,150 | A | * | 12/1997 | Komuro et al. | 218/129 |
| 6,107,582 | A | * | 8/2000 | Okutomi et al. | 218/130 |
| 6,437,275 | B1 | * | 8/2002 | Kikuchi et al. | 218/123 |

FOREIGN PATENT DOCUMENTS

| | | |
|---|---|---|
| JP | 49-17311 | 2/1974 |
| JP | 07-029461 | 1/1995 |
| JP | 08-143910 | 6/1996 |
| JP | 10-040761 | 2/1998 |
| JP | 11-250782 | 9/1999 |
| JP | 11-250783 | 9/1999 |

* cited by examiner

*Primary Examiner*—Karl D. Easthom
*Assistant Examiner*—M Fishman
(74) *Attorney, Agent, or Firm*—Antonelli, Terry, Stout & Kraus, LLP

(57) ABSTRACT

An electrode comprises an electrode main body having a porosity, and the conductivity of the electrode main body at its part ranging from the arc running face to a stated depth is made higher than the conductivity at the section or the conductivity at the part ranging from the back surface to a stated depth. This brings about an improvement in circuit-break performance of a circuit breaker and also prevents the arc running face of the electrode main body from deteriorating.

16 Claims, 13 Drawing Sheets

SINTERED BODY AND ELECTRODE, METHOD FOR SURFACE DENSITICATION OF THESE, PROCESS FOR MANUFACTURING ELECTRODE BY THIS METHOD AND CIRCUIT BREAKER

This application is based on Japanese Patent Application No. 2001-216589 filed in Japan, the contents of which are incorporated hereinto by reference.

BACKGROUND OF THE INVENTION

1. Field of the Invention

This invention relates to a sintered body, a method for its surface densitication, a process of working and manufacturing an electrode by this method, and a circuit breaker such as a vacuum vessel.

2. Description of the Related Art

Vacuum circuit breakers are devices which open and close high voltage and large electric current by opening and closing the path between a movable electrode and a fixed electrode which are placed in a vacuum container. In such a vacuum circuit breaker, an electric arc is formed between the movable electrode and the fixed electrode at the time of circuit breaking. This arc is considered to be an ionized gas or hot electrons of the material component of electrodes. The arc between the movable electrode and the fixed electrode disappears once this ionized gas has sufficiently diffused. However, when reignition (restriking) voltage rises before that, it causes the arc to be again formed between the movable electrode and the fixed electrode to make circuit break impossible. Accordingly, in order to avoid such a phenomenon, vacuum circuit breakers are required to have a high circuit-break performance.

This breaking performance of vacuum circuit breakers is known to be greatly influenced by the material properties of arc electrode portions at the part facing the arc running faces of electrodes, and experiments are made using a variety of material systems. As the result, as materials for the electrodes, it has been considered preferable to use melted-and-forged alloys such as Cu—Bi, Cu—Te or sintered alloys such as Cu—Mo, Cu—W.

The electrodes of the vacuum circuit breakers are also required to have performances such that they can handle a large circuit-break current, have a high breakdown strength, have a sufficient conductivity to cause less heat generation, and do not cause any fusion bond between the movable electrode and the fixed electrode. Accordingly, a Cu—Cr alloy is in wide used, as satisfying all the performances in a relatively well balanced state. In this material system, also used are materials to which the third element such as Al, Si, Ta, Nb, Be, Hf, Ir, Pt, Zr, Si, Rh or Ru has been added.

As a method of manufacturing such electrodes of vacuum circuit breakers, a method making use of sintering is inexpensive, and has recently become widely used. When, however, the electrodes are manufactured by a sintering process, there has been a problem that 1 to 10 percentage of voids may remain in the interiors of the electrodes even after the sintering thereby to make the electrodes have a low conductivity.

Electrodes having a high porosity have so low a conductivity as to have a low thermal diffusivity and besides to generate more Joule heat, so that the temperature may greatly rise when the electrodes are electrified.

Hence, the arc running faces of the electrodes tend to deteriorate. Also, referring to the circuit-break performance of vacuum circuit breakers, the temperature rise occurs at arc electrodes. Hence, more metallic elements vaporize and ionize at the time of circuit break of the vacuum circuit breaker thereby to cause a delay in attenuation of the arc and a lowering of breaking performance of the vacuum circuit breaker.

Hence, it is preferable for the electrodes to have a high density. Accordingly, in the case when the electrodes are prepared by sintering, various methods are employed in order for the electrodes to be improved in density.

For example, as a method commonly used to improve the relative density of materials after sintering, sinter forging is available in which the materials are forged after sintering as they are kept at a high temperature. This conventional sinter-forging, however, is very expensive for both forging equipment and forging molds and requires great equipment investment.

As a method of improving the density only at the surface, shot peening disclosed in Japanese Patent Application Laid-open No. 49-17311 is known in the art. However, this shot peening, too, requires equipment exclusively used therefor, resulting in great equipment investment, and besides it has a disadvantage that a workpiece to be worked may chip when it is brittle.

A method in which a sintered product is compressed by rolling after sintering is also disclosed in Japanese Patent Application Laid-open No. 8-143910. However, this method making use of surface rolling, too, requires great equipment investment like the above methods. Also, working objects are inevitably limited to plate-like products.

As disclosed in Japanese Patent Application Laid-open No. 11-250783, it is further attempted to use a Cu—TiC alloy in arc electrode materials for vacuum vessels. Sinter infiltration is also used as a method by which the electrodes are improved in density while their compositional distribution is kept uniform, and electrodes made integrally of materials having different physical properties have been put into practical use in order to make the electrodes have higher function. For example, Japanese Patent Application Laid-open No. 7-29461 discloses an integrally infiltrated electrode in which a arc electrode material which is usually an alloy of metals of two or more types and its electrode support member which is a single-phase alloy of a high-conductivity material such as Cu are made into an integral structure which is metallographically continuous structure so that the mechanical strength can be improved and the number of assemblage steps can be reduced.

Recently, as a working method by which electrode performance can be improved, it is proposed as disclosed in Japanese Patent Application Laid-open No. 11-250782 that a working object which is held and kept rotated is worked by cutting away an end of the working object by means of a cemented carbide lathe cutting tool, followed by a first step in which, rotating the working object regularly, it is worked by cutting by means of a diamond lathe cutting tool, and then a second step in which, rotating the working object reversely, the worked surface of the working object is finished by burnishing using a flank face of a diamond lathe cutting tool set more extended by 0 mm to 0.005 mm than that of the first step, to improve surface roughness of the worked surface of the working object.

This technique is to smooth the worked surface of the working object so that any protrusions coming to be starting points of arc discharge at the time of circuit break can be removed and the circuit-break performance can be improved. This working method can at least meet expectations for the improvement in breakdown strength, but can not improve the conductivity of sintered materials. This is because plate thickness loss necessarily takes place when any porosity kept within a significant range is lessened by working from the surface according to this method in order to improve the performances of electrodes for circuit breakers, but any plate thickness loss can by no means take place beyond the depth of cut. For example, even when the burnishing is performed in a depth of cut of 0 mm to 0.005 mm using the back of a diamond lathe cutting tool for cutting, the plate thickness loss and the interior porosity loss are substantially zero.

SUMMARY OF THE INVENTION

An object of the present invention is to provide an inexpensive circuit breaker having superior current break-off performance (breaking performance), an electrode used therein, a manufacturing process and a method for surface densitication which are used for manufacturing the electrode, and a sintered body at least part of the surface of which has been compacted by the method for surface densitication.

To achieve the above object, the present invention provides an electrode comprising an electrode main body formed of the same material as a whole, wherein the conductivity of the electrode main body at its part extending from the arc running face to a stated depth is higher than the conductivity of the whole electrode main body. Here, the above stated depth may be, e.g., a half of the thickness of the electrode main body (i.e., the thickness from the arc running face to the back surface). Incidentally, the back surface is herein meant to be the surface on the side opposite to the arc running face.

In the present invention, the stated depth may also be 2 mm, where the conductivity of the electrode main body at its part extending from the arc running face to a depth of 2 mm can be made at least 1.2 times the conductivity of the whole electrode main body or the conductivity of the electrode main body at its part extending from the back surface thereof to a depth of 2 mm.

The present invention also provides an electrode comprising an electrode main body, wherein the porosity of the electrode main body at its part extending from the arc running face to a stated depth (e.g., 0.5 mm) is lower than the porosity of the whole electrode main body.

In the present invention, the electrode main body may be provided with a through hole extending from the arc running face to reach the back surface, and the arc running face may be provided with a groove. The electrode main body of the electrode of the present invention may preferably comprise a sintered alloy. Also, the electrode main body may preferably have an average porosity of from 1 to 10 vol. %.

The present invention still also provides a circuit breaker comprising the above electrode of the present invention.

The present invention further provides a method for surface densitication, comprising steps of working a working object by cutting away a part of the surface of the working object with a cutting tool to form a worked surface, and working the worked surface by burnishing with a burnishing tool to cause the surface to retreat, to densiticate the worked surface portion by plastic deformation, wherein said working object is held and kept rotated. And the present invention also provides a sintered body having been densiticated at at least part of its surface by such the method for surface densitication.

As the burnishing tool, a milling type burnishing tool may be used. Where the milling type burnishing tool is used, the burnishing can be performed even when the worked surface is previously provided with a groove or grooves and can not be worked by a lathe.

The extent of retreat of the worked surface as a result of burnishing may preferably be 300 μm or less in order to ensure the thickness precision of the electrode. If burnishing conditions are so set as to provide a larger extent of retreat than that, the electrode may have a non-uniform finish thickness because of a non-uniform porosity of its stock product. On the other hand, where an electrode having a porosity of 10% is worked by burnishing under conditions which provide the extent of retreat of 300 μm or less, the porosity in the range of 2 mm from the arc running face, which influences electrode performance, can be made sufficiently small.

For the working object used in this method for surface densitication of the present invention, a sintered body is particularly suited. Preferred are, besides the electrode main body described above, sintered component parts (sintered bodies) which are desired to be made to have a higher strength at particular portions or a higher surface hardness after molding, such as guides, pushes, cam rings, pulleys and gears of automobiles and dynamos.

There are no particular limitations on the worked surface to which the method for surface densitication is applied. It may appropriately be selected according to the shapes of working objects and the purposes of working. For example, outer peripheries, inner peripheries, edgeface and through-hole inner walls of working objects may be set as worked surfaces.

In the case when the worked surface stands provided with a groove, the burnishing may be carried out through a tool path such that the relative movement between the working object and the burnishing tool is in parallel to the worked surface and also the burnishing tool is brought into contact with the whole worked surface. This enables densitication of the worked surface portion except the groove inner wall.

The present invention still further provides a process for manufacturing an electrode, comprising the step of densiticating at least part of the surface of an electrode main body by the above method for surface densitifcation according to the present invention. As steps other than this step of densitication, the process may be provided with, e.g., a molding step of molding a conductor powder as a raw material in the shape of an electrode main body to obtain a molded body, and a sintering step of heating the molded body to effect sintering to obtain the electrode main body.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE INVENTION

Figure 1:
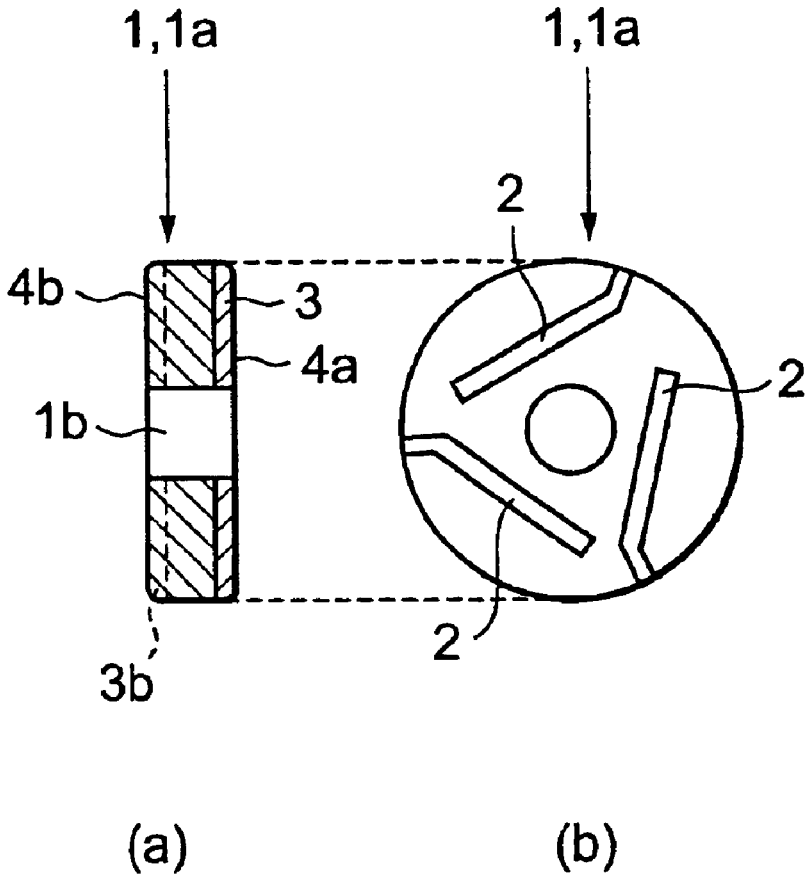
FIGS. 1(*a*) and 1(*b*) illustrate an electrode prepared in Embodiments 1 to 3.

The electrode of the present invention may preferably be provided with a through hole extending from the arc running face to the back surface of the electrode main body. The electrode of the present invention may preferably have a groove or grooves formed in the arc running face of the electrode main body.

According to the present invention, the conductivity of the electrode main body at its part ranging from the arc running face to a depth of 2 mm can be made higher by at least 1.2 times than the conductivity at the section or the conductivity at the part ranging from the back surface to a depth of 2 mm. In such a case, the conductivity of the electrode main body at its arc running face can be made higher by at least 20% than the conductivity at the section or that at the back surface.

According to the present invention, the porosity of the electrode main body at its part ranging from the arc running face to a stated depth (e.g., 0.5 mm) can be made smaller than the average porosity of the whole electrode main body. This enables manufacture of an electrode having an arc running face with a high density, only through simple steps without requiring any great equipment investment as in conventional cases, and hence enables achievement of cost reduction in the manufacture of electrodes.

In the electrode of the present invention, the conductivity of the electrode main body at its surface on the side of the arc running face (i.e., the conductivity at the part ranging from the surface to a stated depth) has been made higher than the whole electrode main body. Hence, there is no possibility of causing any great Joule heat to be generated at the arc running face of the electrode main body, and the temperature does not rise greatly at the time of electrification. Hence, the arc running face of the electrode main body can be prevented from deteriorating. Also, the electrode of the present invention does not cause any delay in attenuating the arc at the time of circuit break, and promises a high breaking performance.

Moreover, in the electrode of the present invention, the conductivity is enhanced by making the electrode main body have a lower porosity at its arc running face, in the step of surface densitication carried out using a general-purpose working machine. Hence, it does not require any great equipment investment as in conventional cases, and can be manufactured at a low cost only through simple steps. The electrode of the present invention has a high conductivity at its surface, and is especially suited for circuit breakers.

According to the working method of the present invention, the worked surface at an end of the working object is worked by burnishing by means of a burnishing tool to cause the surface to retreat, to densiticate the worked surface portion of the working object by plastic deformation. Hence, the porosity at the worked surface portion of the working object can be made small and the worked surface portion can be made dense and hard. This enables improvement in strength of the worked surface portion and also, when a conductor sintered body is worked, enables its surface to have much higher conductivity. Also, there are no particular limitations on the worked surface, which may appropriately be selected according to the shapes of working objects and the purposes of working, as exemplified by outer peripheries, inner peripheries, edge face and through-hole inner walls.

In the working method of the present invention, the worked surface portion may be densiticated by burnishing carried out through a tool path such that the relative movement between the working object and the burnishing tool is in parallel to the worked surface at an edge face of the working object and also the burnishing tool is brought into contact with the whole worked surface of the working object. In such a case, even when grooves are previously formed in the arc running face of the working object, the porosity at the worked surface portion except the grooves of the working object can be made small and the worked surface portion can be improved in strength (and conductivity in the case of conductors).

THE PREFERRED EMBODIMENTS

Embodiments of the present invention are described below with reference to the drawings. The present invention is by no means limited to these. In the following embodiments, electrodes for vacuum circuit breakers are prepared which electrodes are formed of sintered materials composed chiefly of Cu—Cr. The present invention can be expected to be likewise effective for other sintered stock products, and those to which it is to be applied are also by no means limited to the electrodes. Also, burnishing-tool materials and shapes and burnishing conditions are also appropriately changeable.

Embodiment 1

A. Electrode and Circuit Breaker Structure

An electrode 1 prepared in this embodiment is shown in FIG. 1(*a*) as a sectional view and FIG. 1(*b*) as a plan view. An electrode main body 1*a* of the electrode 1 is comprised of a sintered body (a sintered alloy of Cr and Cu; Cr:Cu=25:75 in weight ratio) having fine voids therein. The electrode main body 1*a* has an average porosity of from 1 to 10 vol. %. In the electrode main body 1*a*, along its axis a through hole 1*b* is bored between an arc running face 4*a* and a back surface 4*b*. Also, in the electrode 1, a arc electrode portion 3 having been compacted is integrally formed at an end on the side of the arc running face 4*a* of the electrode main body 1*a*.

The electrode main body 1*a* in this embodiment is formed of a homogeneous material, but only on the part of the arc running face 4*a*, it has been densiticated to have less voids. More specifically, the porosity of the electrode main body 1*a* at its part ranging from the arc running face 4*a* to a depth of 0.5 mm has been made smaller than the average porosity of the whole electrode main body 1*a*.

Thus, in the electrode 1 of this embodiment, the conductivity of the electrode main body 1*a* at its part ranging from the arc running face 4*a* to the stated depth has been made higher than the conductivity at the section or the conductivity of the electrode main body 1*a* at its part ranging from the arc running face 4*a* to the stated depth. More specifically, the conductivity of the electrode main body 1*a* at its part 3 ranging from the arc running face 4*a* to a depth of 2 mm has been made higher by at least 1.2 times than the conductivity at the section and the conductivity at the part 3*b* ranging from the back surface 4*b* to a depth of 2 mm respectively.

Next, a circuit breaker manufactured according to this embodiment is described with reference to FIG. 2. The circuit breaker of this embodiment is a vacuum circuit breaker (vacuum vessel) V which interrupts a circuit upon separation of a movable electrode 6 from a fixed electrode 5 which are in contact with each other at the time of electrification, and are separated by operating a movable conductor 8. In each of the fixed electrode 5 and the movable electrode 6, the electrode 1 of this embodiment described above is used.

The vacuum vessel V of this embodiment has a fixed electrode 5, a movable electrode 6 which is so provided as to be capable of coming into contact with or separating from the fixed electrode 5, a fixed conductor 7 connected to the fixed electrode 5, a movable conductor 8 connected to the movable electrode 6, a guide 9 for moving the movable conductor 8 linearly, a ceramic insulated cylindrical body (ceramic cylinder) 10 serving as a vacuum container, a fixed-side terminal plate 11 which closes an opening at the upper end of the ceramic cylinder 10, a bellows 12 provided on the outside of the movable conductor 8, a movable-side terminal plate 13 which closes an opening at the lower end of the ceramic cylinder 10, a bellows shield 14 so fitted to the movable conductor 8 as to face the bottom side of the movable electrode 6, and an intermediate shield 15 provided on the inside of the ceramic cylinder 10.

The vacuum vessel V is hermetically closed in order to keep the inside vacuum. On the side of the fixed electrode 5, the ceramic cylinder 10, the fixed-side terminal plate 11 and the fixed conductor 7 are so connected as to have no gap between them. On the side of the movable electrode 6, the upper end of the bellows 12 formed in bellows structure so as to be expandable and contractable, using SUS (stainless steel) of about 0.1 mm thick, is so connected to the movable conductor 8 as to have no gap between them, the lower end of the bellows 12 is so connected to the lower end of the ceramic cylinder 10 as to have no gap between them, and the movable-side terminal plate 13 is so connected to the lower end of the ceramic cylinder 10 as to have no gap between them.

Incidentally, the bellows shield 14 and the intermediate shield 15 are provided to protect the bellows 12 and ceramic cylinder 10 from an arc caused between the fixed electrode 5 and the movable electrode 6.

Grooves 2 (FIG. 1) in the arc running face 4*a* of the electrode 1 are provided to improve circuit-break performance of the vacuum vessel V by rotating the electrode by the aid of electromagnetic force, adding a magnetic field in the direction lateral to the arc caused between the fixed electrode 5 and the movable electrode 6 when the vacuum vessel V breaks off the flow of a large electric current. In this embodiment, they are grooves formed symmetrically between the fixed electrode 5 and the movable electrode 6.

Incidentally, the shape of the groove 2 formed in the arc running face 4*a* of the electrode 1 may be designed in variety. In the present invention, the shape is by no means limited to that of the groove shown in this embodiment. The present invention is applicable also to electrodes having no groove.

B. Electrode Manufacturing Process

Subsequently, the electrode manufacturing process according to the present invention is described with reference to FIG. 3.

Figure 3:
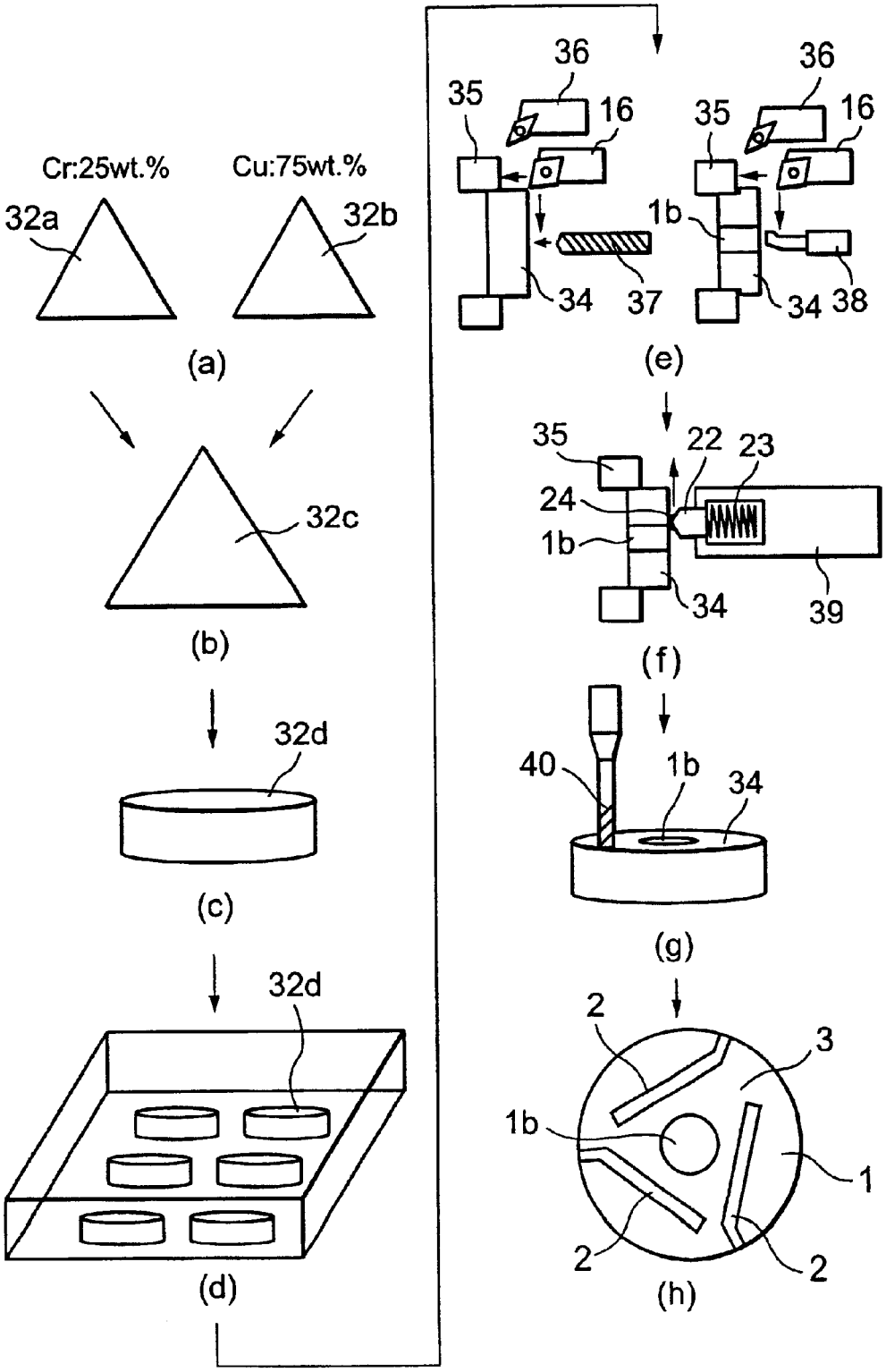
FIGS. 3(*a*) to 3(*h*) illustrate the steps of manufacturing an electrode in Embodiments 1 to 3.

In this embodiment, first, as shown in FIG. 3(*a*), metal powders Cr powder 32*a* and Cu powder 32*b* are weighed as raw materials (weighing step). Here, the Cr powder 32*a* and Cu powder 32*b* may preferably be used in amounts of 25% by weight and 75% by weight, respectively.

Next, as shown in FIG. 3(*b*), the Cr powder 32*a* and Cu powder 32*b* are mixed to prepare a mixed powder 32*c* (mixing step). Then, as shown in FIG. 3(*c*), the mixed powder 32*c* is compact-molded at a stated pressure to form a molded body (green compact) 32*d* (molding step). Thereafter, as shown in FIG. 3(*d*), the green compact 32*d* is sintered in a furnace 33 at a high temperature of about 1,000° C. to form a sintered body 34 as an electrode main body (sintering step).

Then, as shown in FIG. 3(*e*), using a lathe (not shown) having the function of automatic tool change (ATC), the sintered body 34, having been gripped with chuck jaws 35, is roughing on its outer periphery and back-end surface with a cemented carbide turning tool 16, and thereafter a through hole 1*b* is bored in the sintered body 34 by means of a drill 37 to carry out drilling. The sintered body 34 thus worked is further worked by finishing its outer periphery and back-end surface by means of a cemented carbide lathe cutting tool 36 (back surface side working step).

Thereafter, in order to work the sintered body 34 on its front-end side serving as the arc running face of the electrode, the sintered body 34 gripped with chuck jaws 35 of the lathe is changed in chuck position. Then, as shown in FIG. 3(*e*), the sintered body 34 is rough-machined on its outer periphery and front-end surface by means of the cemented carbide lathe cutting tool 16, and the sintered body 34 thus worked is further worked by finishing its outer periphery and front-end surface by means of the hard-metal finishing tool 36. Thereafter, the through hole 1*b* of the sintered body 34 is worked by finishing its inner periphery by means of an inner-wall finishing tool 38 (front-surface side working step).

Next, as shown in FIG. 3(*f*), in the same working machine the sintered body 34 is worked by burnishing its front-end surface serving as the arc running face with a burnishing tool 39 (densitication step). Thereafter, as shown in FIG. 3(*g*), the sintered body 34 is worked by grooving the front-end surface by means of a hard-metal end mill 40, using a machining center, to form grooves 2 in the front-end surface serving as the arc running face 4*a* of the sintered body 34. Thus, an electrode 1 is completed as shown in FIG. 3(*h*).

In this embodiment, the performance of the electrode 1 is greatly improved on account of the rough machining of the sintered body 34 on its front-end surface serving as the arc running face 4*a* of the electrode 1, shown in FIG. 3(*e*), and the burnishing of the sintered body 34 on its front-end surface, shown in FIG. 3(*f*).

C. Evaluation of Electrode

Figure 4A:
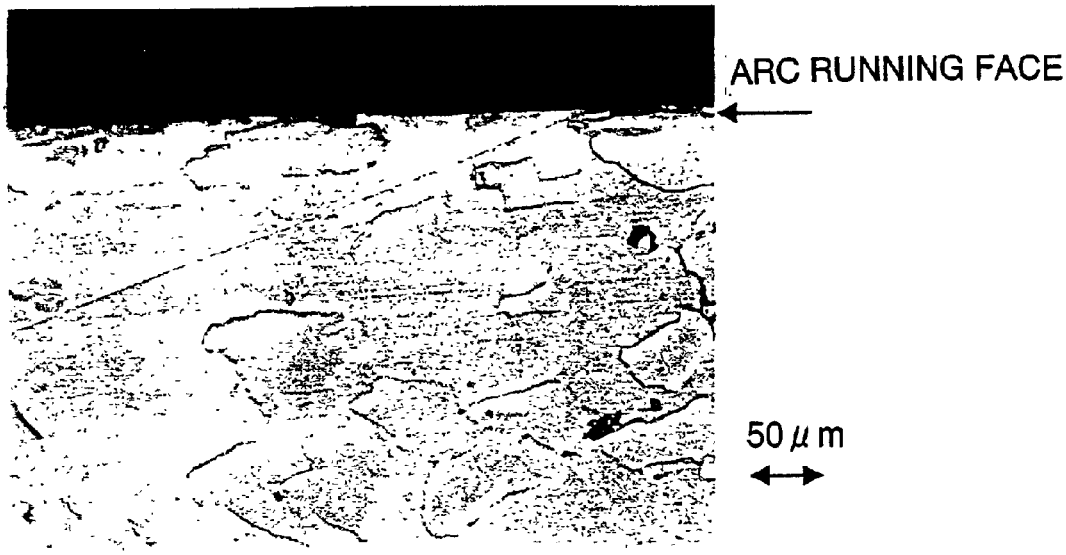
FIGS. 4A and 4B are photomicrographic images showing sections of an electrode.
Figure 4B:
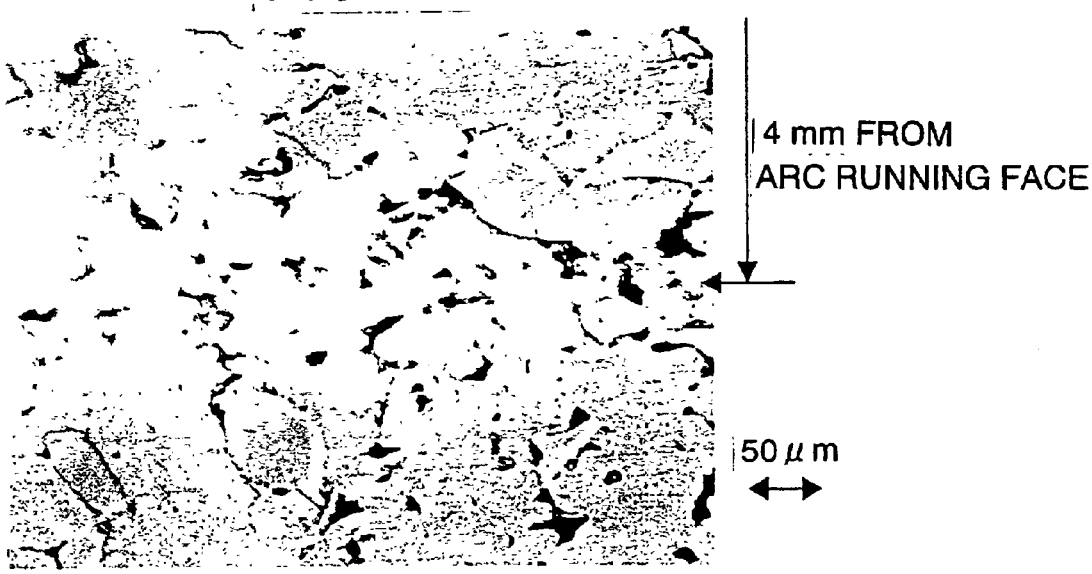

Photomicrographic images of the electrode obtained according to this embodiment are shown in FIGS. 4A and 4B. Here, FIG. 4A shows a section of the electrode 1 at its arc electrode part 3 (FIG. 3H) ranging from the arc running face 4*a* to a depth of 0.5 mm, and FIG. 4B shows a section of the electrode main body 1*a* at its substantially middle part. As can be seen from these photographs, the porosity at the arc electrode part 3 has been made smaller than the average porosity of the whole electrode main body 1*a*, bringing about an improvement in conductivity of the electrode 1 at its arc electrode part 3.

Ideal density, measured density and porosity after sintering, of sintered stock products to be made into electrodes 1 are shown in Table 1.

The ideal density, measured density and porosity after sintering, of sintered stock products are, as shown in Table 1, 8.441 g/cm$^3$ on the average, 8.151 g/cm$^3$ on the average and 3.4% on the average, respectively. Here, the porosity is measured by the Archimedes method.

TABLE 1

| Sample | A | B | C | Average |
|---|---|---|---|---|
| Ideal density (g/cm$^3$) | 8.441 | 8.441 | 8.441 | 8.441 |
| Measured density (g/cm$^3$) | 8.179 | 8.157 | 8.117 | 8.151 |
| Porosity (%) | 3.1 | 3.4 | 3.8 | 3.4 |

In respect of the arc running faces, sections and back surfaces after sintering, after roughing and after burnishing, of sintered stock products to be made into electrodes 1, the results obtained by measuring their conductivity (International Annealed Copper Standard; herein simply "IACS %") by the eddy current method are shown in Table 2. In the present invention, the IACS % is measured in respect of the arc running faces, sections and back surfaces of sintered stock products after sintering, after roughing and after burnishing, using sintered stock products of 53 mm in diameter and 11.7 mm in thickness, comprised of 25% of Cr and 75% of Cu.

TABLE 2

| | After sintering | After roughing | After burnishing |
|---|---|---|---|
| Arc running Face | 26.4 | 30.8 | 36.4 |
| Section | 28.2 | 27.8 | 27.7 |
| Back surface | 27.5 | 26.5 | 25.2 |

Figure 5:
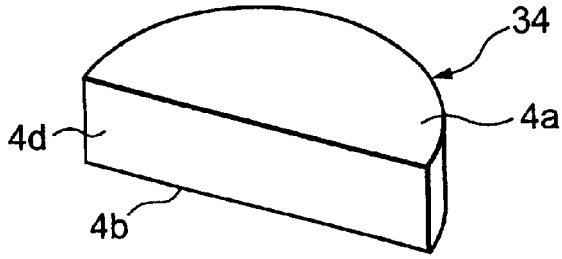
FIG. 5 illustrates the part where the conductivity of a sintered stock product is measured.

The IACS % is the relative value of conductivity, regarding the conductivity of a soft copper wire as a standard. In this embodiment, it is measured by a method in which a gauge head (diameter: 10 mm) is brought into contact with the surface of a sintered stock product at its measuring spot and a change of eddy current is converted into resistance. In this measuring method, the conductivity of the sintered stock product at its part ranging from the surface to a depth of 2 mm can be measured. This range is substantially the same as the range which has influence on the circuit-break performance of the electrode 1. Also, the IACS % in this embodiment is measured at, as shown in FIG. 5, the arc running face 4*a*, back surface 4*b* and section 4*d* of a sintered stock product to be made into a sintered body 34.

As shown in Table 2, in the state the sintered stock products have only been sintered, they all show a low IACS % at each portion, of 26.4% at the arc running face, 28.2% at the section and 27.5% at the back surface, because of a porosity. In contrast thereto, after the roughing, they show IACS % of 30.8% at the arc running face, 27.8% at the section and 26.5% at the back surface; and, after they have further worked by burnishing, 36.4% at the arc running face, 27.7% at the section and 25.2% at the back surface. Thus, the IACS % at the arc running face is seen to come higher as a result of working.

The IACS % at the section can be regarded as the conductivity of the sintered stock product after sintering. Therefore, it is considered from these results that the conductivity of the sintered stock product at its arc running face after burnishing has been able to be made higher by 1.3 times than the conductivity of the sintered stock product at its section as a result of the working of the sintered stock product by burnishing.

Working conditions used when the sintered stock product is worked by burnishing using the burnishing tool 39 are as follows: The sintered stock product is worked by feeding the burnishing tool 39 on the former's surface in the direction of from its inner periphery to its outer periphery in the state that a preload is kept applied at 310 N, and at a burnishing level of 0.3 mm, a number of revolutions S of 500 rev./min. and a feed f of 0.1 mm/rev.

D. Tools Used and Working Conditions

Next, the tools and working conditions used in the present invention are described in detail. In this embodiment, the working object sintered body 34 comprised of the sintered stock product having fine voids is held and kept rotated, and is worked by cutting away an end of the sintered body with the cutting tool (cemented carbide lathe cutting tool 16), and thereafter the sintered body 34 is worked by burnishing the worked surface of that end with the burnishing tool 39 to cause the worked surface of the sintered body 34 to retreat, to compact the worked surface portion of the sintered body 34 by plastic deformation.

Figure 6:
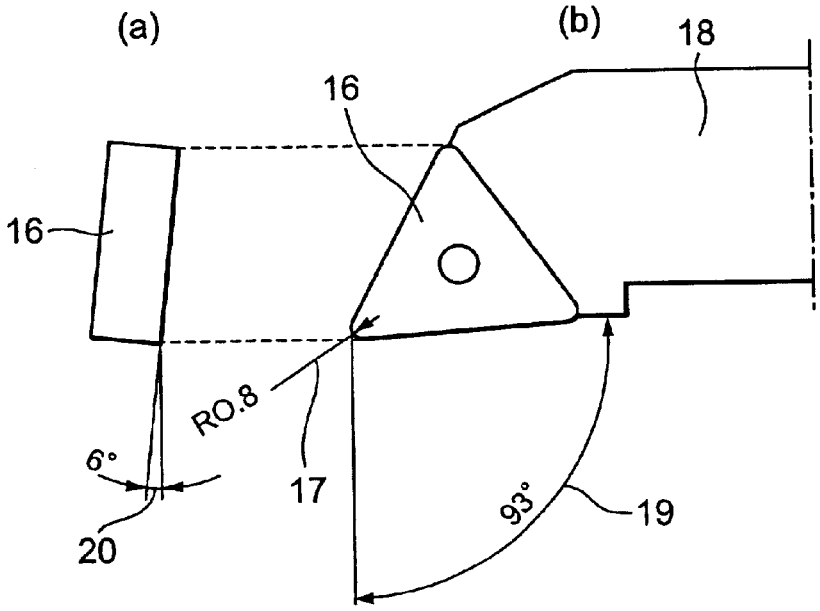
FIGS. 6(*a*) and 6(*b*) illustrate a cemented carbide lathe cutting tool used in the working of electrodes.

The cemented carbide lathe cutting tool 16 is used to carry out the roughing of the arc running face 4*a* of the sintered body 34 to be made into the electrode. Its front view and side view are shown in FIG. 6A and FIG. 6B, respectively. The cemented carbide lathe cutting tool 16 used in this embodiment is a throw-away turning tool having a throw-away insert (tip) 16*a* coated with TiN, having a side of 16 mm and a thickness of 4 mm and corresponding to hard metal K25. The throw-away insert 16*a* of the cemented carbide lathe cutting tool 16 has a corner radius 17 of 0.8 mm. Also, the throw-away insert 16*a* of the cemented carbide turning tool 16 has a rake angle 20 of 0° and a side cutting edge angle 19 of 93°. The throw-away insert 16*a* of the cemented carbide lathe cutting tool 16 is attached to a shank 18 of 25 mm square when used.

In this embodiment, the roughing of the sintered stock product at its arc running face by means of the cemented carbide lathe cutting tool 16 is carried out under conditions of a number of lathe main-shaft revolutions S of 500 rev./min., a depth of cut d of 1 mm and a feed f of 0.3 mm/rev. The sintered stock product is cut feeding the throw-away insert 16*a* of the cemented carbide lathe cutting tool 16 on the former's surface in the direction of from its outside diameter to its inside diameter.

Subsequently, the burnishing tool 39 used in this embodiment is described in detail with reference to FIG. 7. The burnishing tool 39 is used to work the sintered body 34 to be made into the electrode, by burnishing its arc running face 4*a*.

Figure 7:
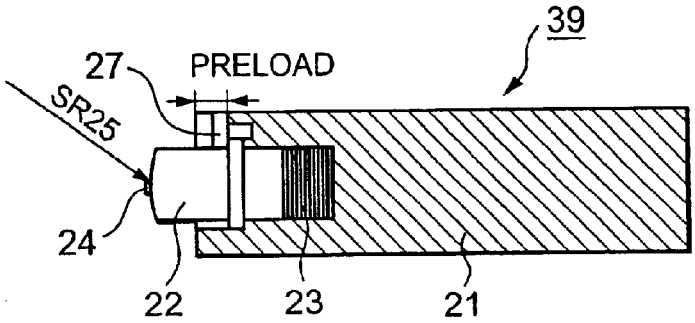
FIG. 7 illustrates a burnishing tool used in the working of electrodes.

The burnishing tool 39 has, as shown in FIG. 7, a shank 21 of 20 mm square, a holding support 22 fitted to the shank 21, a spring 23 for applying a load to the holding support 22, a run-out preventive screw 27 for securing the holding support 22 to the shank 21, and a diamond insert 24 of 10 mm in SR (curvature radius) 25 at its tip, fitted to the holding support 22.

Here, the sintered body 34 which is held and kept rotated may be worked at its outside diameter or inside diameter by cutting away that part with the cutting tool, and thereafter the sintered body 34 may be worked by burnishing the worked surface of its outer periphery or inner periphery with the burnishing tool to cause the worked surface of the sintered body 34 to retreat, to dentisicate the worked surface portion of the sintered body 34 by plastic deformation.

Figure 8:
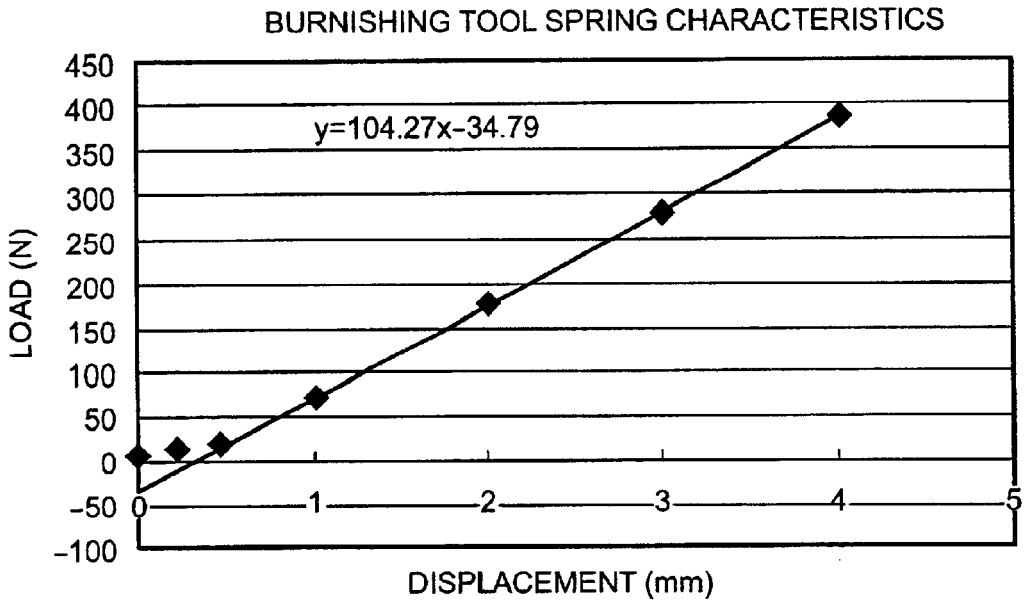
FIG. 8 is a graph showing spring characteristics of the burnishing tool shown in FIG. 7.

Spring characteristics of this burnishing tool 39 are shown in FIG. 8. As can be seen from FIG. 8, the load applied to the holding support 22 of the burnishing tool 39 increases in proportion to an increase in the displacement of the spring 23. Also, a preload may be applied to the spring 23 by controlling the tightening of the run-out preventive screw 27.

Figure 10:
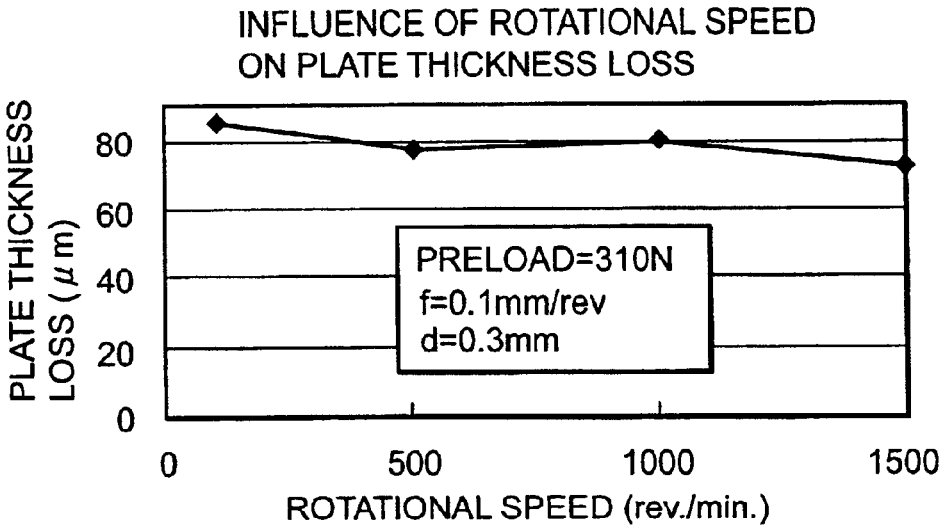
FIG. 10 is a graph showing the influence of rotational speed on plate thickness loss.
Figure 11:
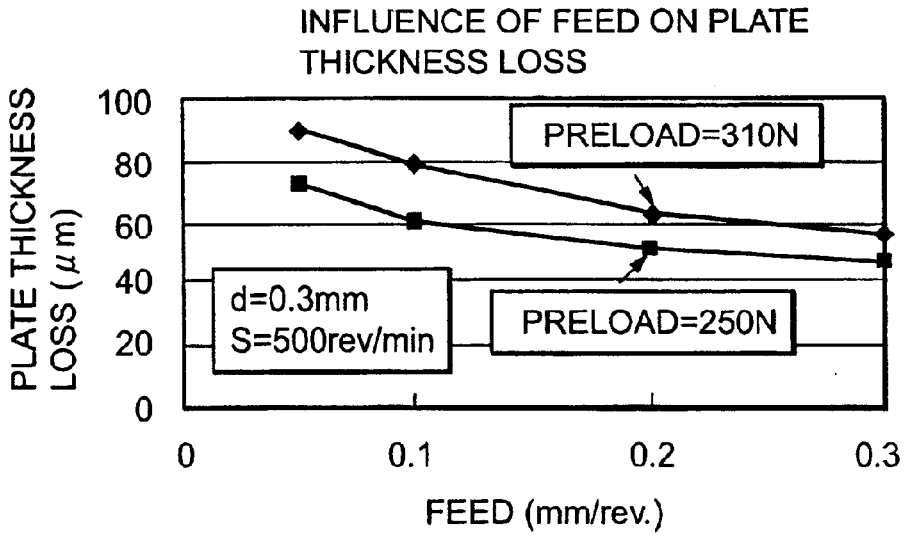
FIG. 11 is a graph showing the influence of feed rate on plate thickness loss.
Figure 12:
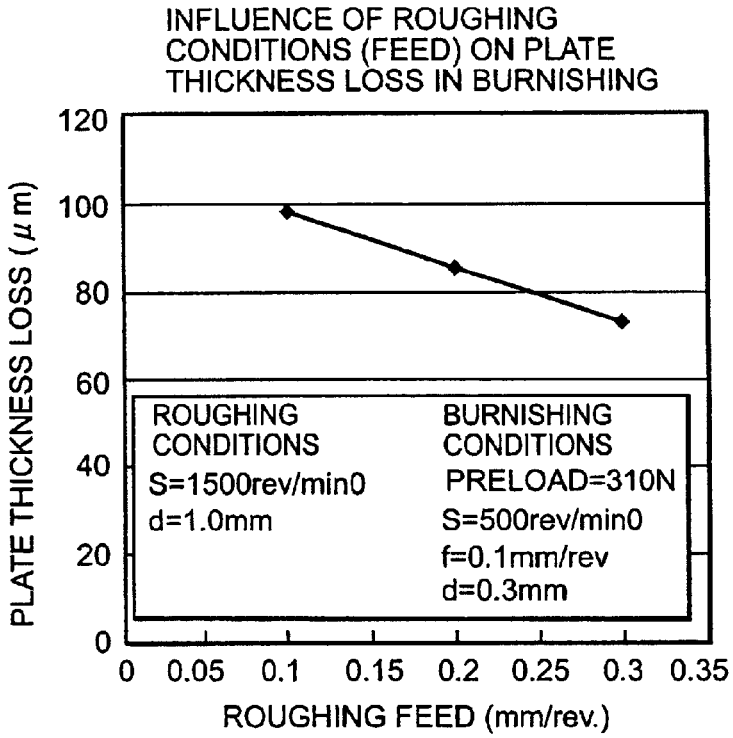
FIG. 12 is a graph showing the influence of the feed rate of rough machining on the plate thickness loss in burnishing.

Then, studies have been made on working conditions by measuring the plate thickness loss of sintered stock products worked under different burnishing conditions. The results of each measurement are shown in FIGS. 10 to 12.

Changes in density of a sintered stock product which extend from the arc running face distribute in the depth direction. To determine their total amount, the loss of plate thickness of the sintered stock product may be measured.

The burnishing level also herein used is the programmed value of an NC (numerical control) working machine on how much the diamond insert 24 of the burnishing tool 39 be made to enter the sintered stock product from its surface in the depth direction.

The value of instruction given to the NC working machine corresponds to the depth of cut which is used in the cut-away working. In the case of the burnishing, however, the holding support 22 of the burnishing tool 39 comes away because of distortion of the spring 23, and hence, the terms "depth of cut" is considered unsuitable. Accordingly, in the present specification, this is termed as the burnishing level. What is found by subtracting the plate thickness loss from the burnishing level is the distortion of the spring 23 of the burnishing tool 39.

The relationship between the rotational speed and the plate thickness loss in the burnishing is shown in FIG. 10. As can be seen from FIG. 10, the rotational speed is considered not to influence the plate thickness loss greatly in the burnishing.

The relationship between the feed speed and the plate thickness loss in the burnishing is shown in FIG. 11. As can be seen from FIG. 11, the plate thickness loss has a tendency to decrease with an increase in the feed speed. Here, the burnishing is carried out under conditions of a preload of 250 N or 310 N, and for each of them a number of revolutions S of 500 rev./min. and a feed f of 0.05 mm/rev., 0.1 mm/rev., 0.2 mm/rev. or 0.3 mm/rev.

Results of measurement on plate thickness loss in burnishing after roughing carried out changing conditions are shown in FIG. 12. Here, the roughing is carried out under conditions of a number of revolutions S of 1,500 rev./min. and a depth of cut d of 1 mm. Also, the burnishing is carried out under conditions of a preload of 310 N, a number of revolutions S of 500 rev./min., a feed f of 0.1 mm/rev. and a burnishing level of 0.3 mm.

As can be seen from FIG. 12, the plate thickness loss of the sintered stock product decreases with an increase in the feed rate of the roughing. This is considered due to the fact that the back force increases with an increase in the feed speed and hence the porosity of the sintered stock product at its surface decreases, though it does slightly, also at the time of roughing. Thus, appropriate combination of working conditions for the pre-step roughing and the burnishing enables achievement of effective burnishing.

Figure 13:
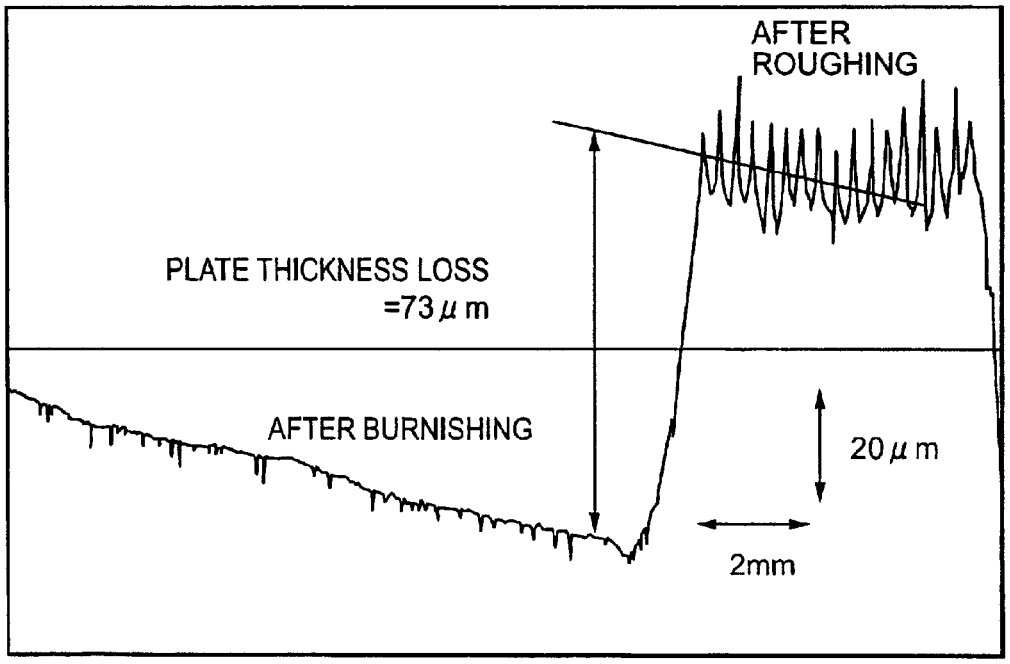
FIG. 13 is a sectional-curve diagram showing a difference in height due to differences in plate thickness loss of a sintered stock product after rough machining and after burnishing.

Next, the plate thickness loss has been measured at a spot of 15 mm in radius from the center of a sintered stock product to examine any difference in height from the part not worked by burnishing. A sectional curve obtained on the sintered stock product after roughing and after burnishing is shown in FIG. 13. Here, the plate thickness loss resulting from burnishing carried out on the front surface after roughing is 73 $\mu$m.

Figure 14:
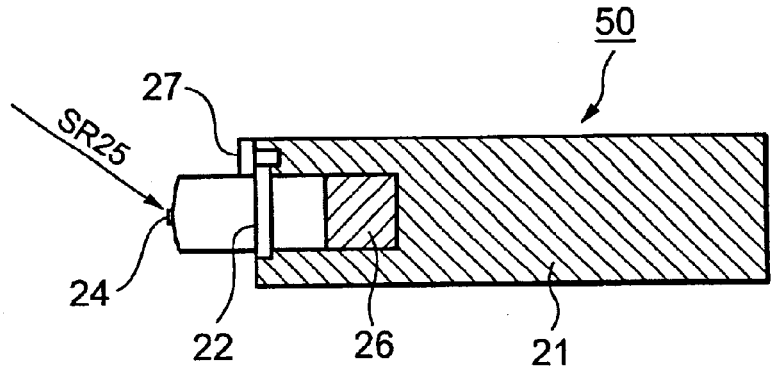
FIG. 14 illustrates a burnishing tool having no spring (springless), used in the working of electrodes.

Subsequently, studies have been made on a case in which a burnishing tool having no spring (springless burnishing tool) is used when the sintered body 34 to be made into the electrode is worked by burnishing its arc running face 4*a*. As shown in FIG. 14, a springless burnishing tool 50 used in this embodiment is provided with a spacer 26 in place of the spring 23, and has a shank 21, a holding support 22 fitted to the shank 21, the spacer 26, a run-out preventive screw 27 for securing the holding support 22 to the shank 21, and a diamond insert 24 of 10 mm in SR (curvature radius) 25 at its tip, fitted to the holding support 22.

Figure 15:
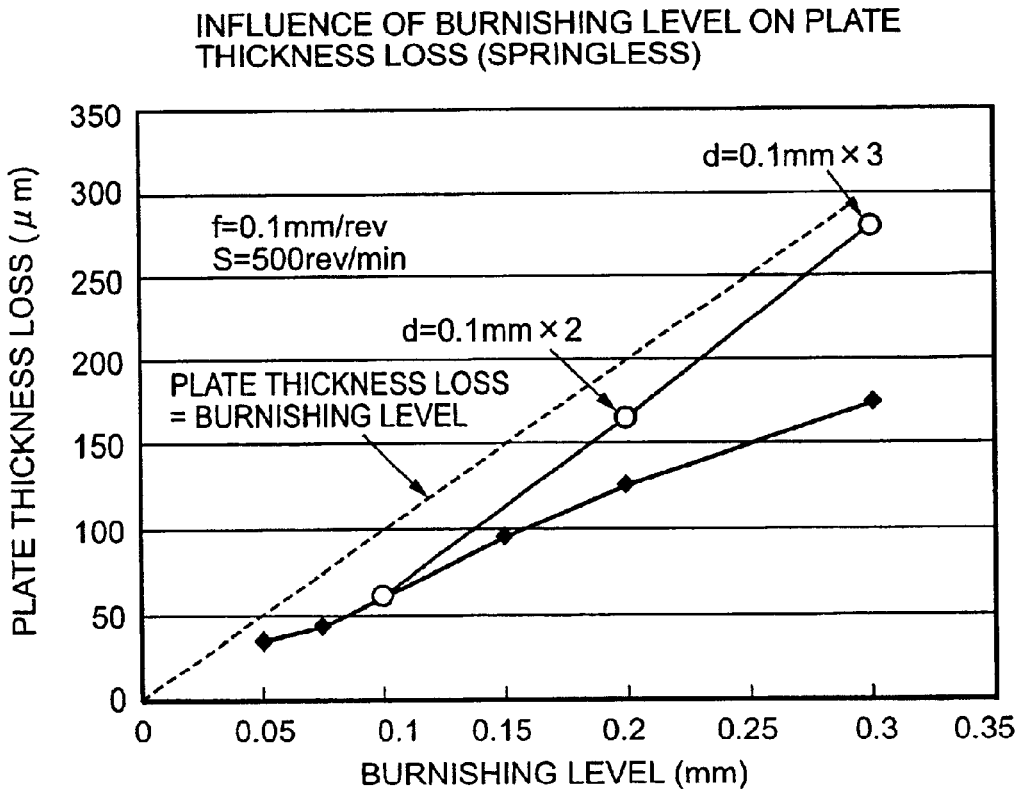
FIG. 15 is a graph showing the influence of burnishing level on plate thickness loss where the burnishing tool having no spring (springless) is used.

Using this springless burnishing tool 50, the burnishing has been carried out under positional control, where any influence of burnishing level on plate thickness loss has been examined to obtain the results shown in FIG. 15. Here, the burnishing is carried out under conditions of a number of revolutions S of 500 rev./min., a feed f of 0.1 mm/rev. and a burnishing level of 0.05 mm, 0.075 mm, 0.1 mm, 0.15 mm, 0.2 mm or 0.3 mm.

In this case too, the burnishing level is not in agreement with the plate thickness change. This is considered due to the fact that the reaction force caused by burnishing has distorted the working machine to make the burnishing tool 50 come away. It has also been found that the burnishing level is larger than that of other methods, and such a burnishing tool 50 is effective in working machines having a high rigidity.

Figure 16:
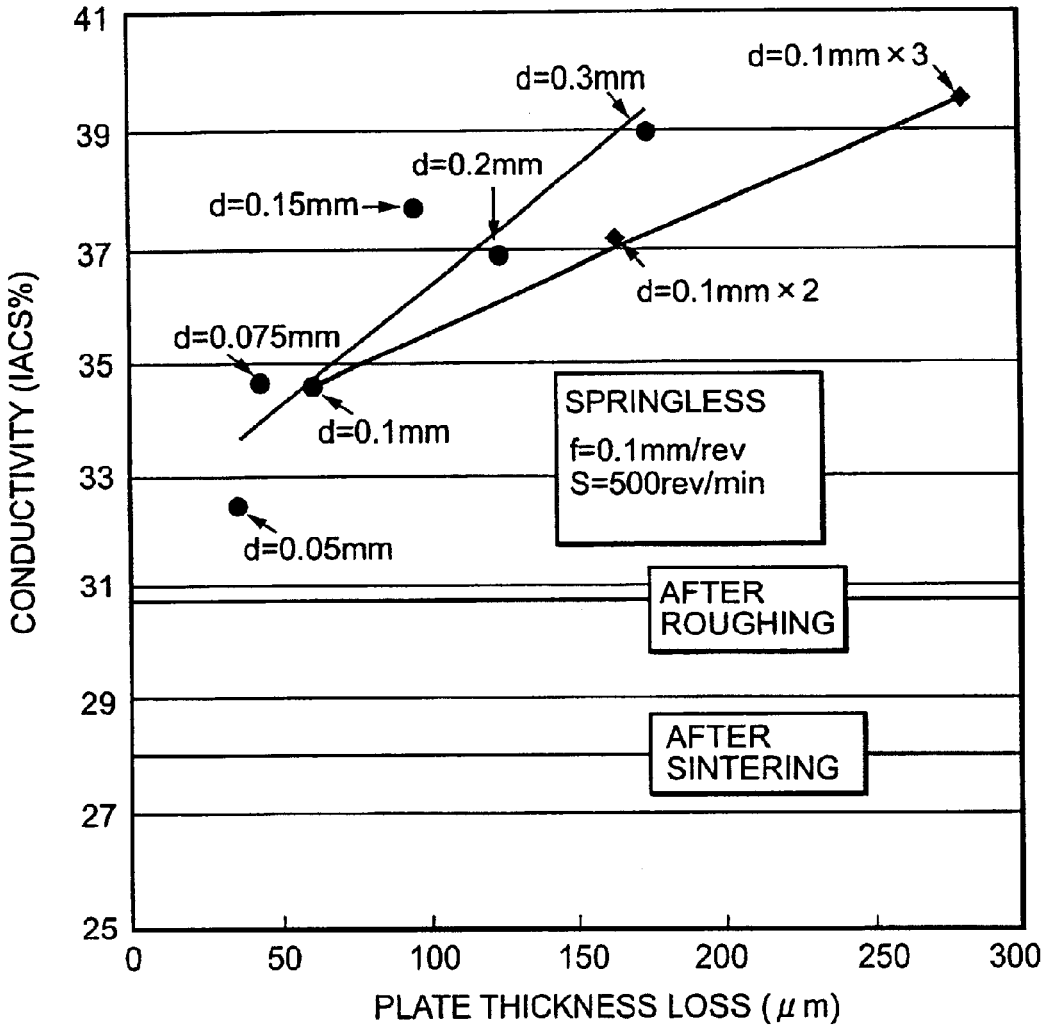
FIG. 16 is a graph showing the relationship between plate thickness loss and IACS % where burnishing is repeatedly carried out changing the burnishing level.

Next, using this springless burnishing tool 50, the burnishing has repeatedly been carried out changing the burnishing level, to examine the relationship between plate thickness loss and IACS %. Results obtained are shown in FIG. 16. Here, the burnishing is carried out under conditions of a number of revolutions S of 500 rev./min., a feed f of 0.1 mm/rev. and a burnishing level of 0.1 mm, repeating the burnishing once, twice or three times. Also, the burnishing level is made larger 0.1 mm by 0.1 mm. Since the distortion of the working machine does not change depending on the number of repetition, the plate thickness loss also comes larger approximately 0.1 mm by 0.1 mm.

As can be seen from FIG. 16, in the case when the burnishing is repeatedly carried out, the plate thickness loss increases, but the IACS % is not so much greatly improved. It has also been found that, in order to improve the IACS %, the plate thickness loss may preferably be controlled to be 50 $\mu$m or more.

Figure 17:
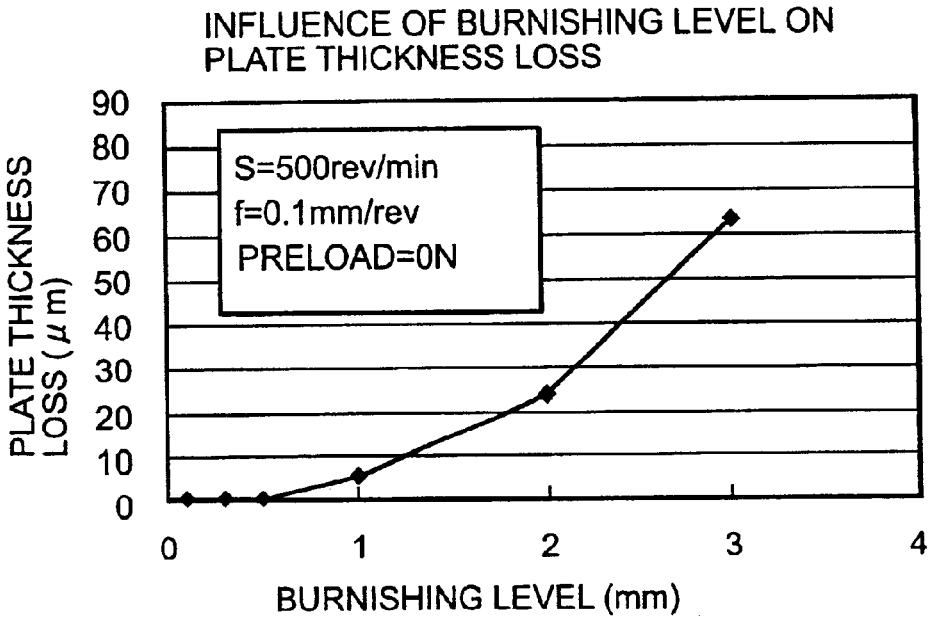
FIG. 17 is a graph showing the influence of burnishing level on plate thickness loss.

The influence of burnishing level on plate thickness loss has been examined without application of any preload to find that, as shown in FIG. 17, the plate thickness loss increases with an increase in the burnishing level. Here, the burnishing is carried out under conditions of a number of revolutions S of 500 rev./min., a feed f of 0.1 mm/rev. and a burnishing level of 0.1 mm, 0.3 mm, 0.5 mm, 1.0 mm, 2.0 mm or 3.0 mm, and any preload is not applied.

Figure 18:
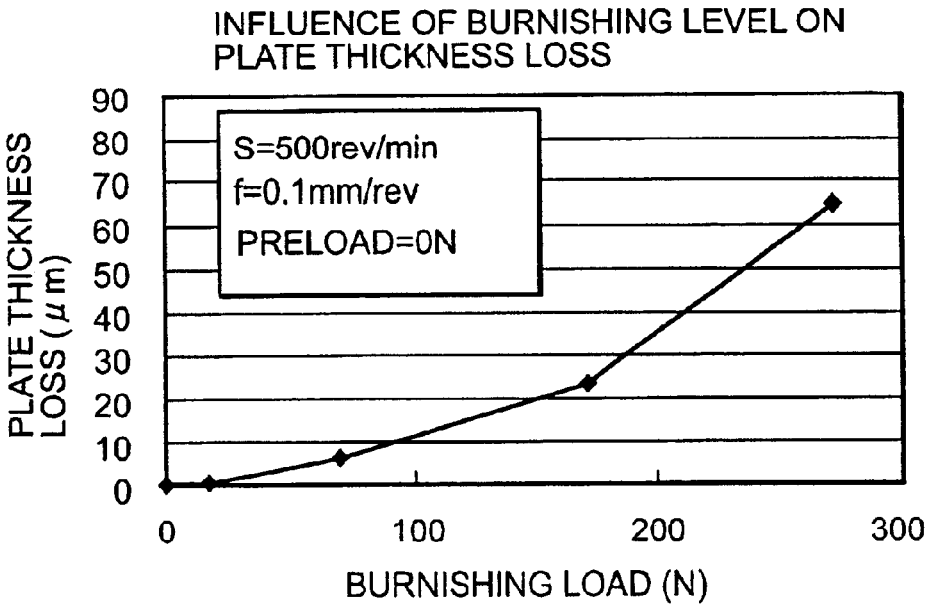
FIG. 18 is a graph showing the influence of burnishing level on plate thickness loss.

On the basis of the results shown in FIG. 17, the influence of burnishing level on plate thickness loss has also been examined from the relationship between burnishing load calculated from spring characteristics and plate thickness loss, to find that, as shown in FIG. 18, the plate thickness loss increases with an increase in the burnishing load.

Embodiment 2

The effect attributable to the method for surface densitication by the burnishing carried out on the sintered stock product is by no means limited to the improvement of conductivity. An embodiment is described below in which the sintered stock product is worked by this method for surface densitication, for the purpose of improving its strength.

Figure 2:
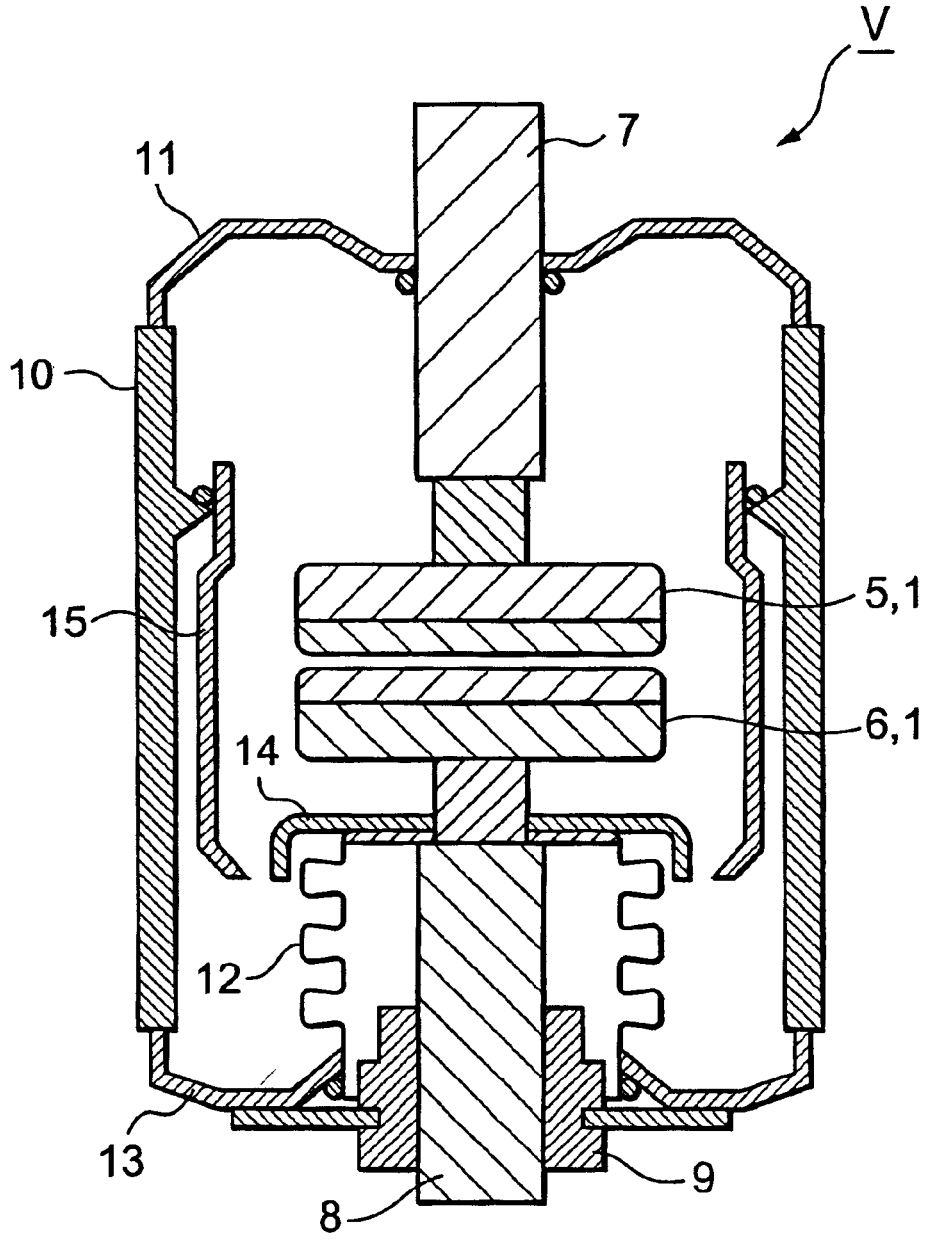
FIG. 2 illustrates a circuit breaker prepared in Embodiments 1 to 3.

As shown in FIG. 2, in the vacuum circuit breaker V, the fixed conductor 7 and the movable conductor 8 are fixed to the fixed electrode 5 and the movable electrode 6, respectively, in the state the former's ends are inserted into the latter's through holes, having an inner diameter of about 10 mm. Hence, in order to ensure precision, the through holes of the fixed electrode 5 and movable electrode 6 are required to have a high inner-diameter precision. Also, these through holes are required to have a certain strength so that the inner diameter of the through holes of the fixed electrode 5 and movable electrode 6 is not enlarged upon contact of the movable conductor 8 with the fixed conductor 7, after the fixed conductor 7 and movable conductor 8 have been fitted to the through holes of the fixed electrode 5 and the movable electrode 6.

Accordingly, in this embodiment, the sintered stock product is worked by burnishing its through-hole inner periphery to lessen the porosity at the through-hole inside diameter so that its strength can be improved.

More specifically, in this embodiment, after the sintered body 34 being held has been worked by drilling by means of the drill 37 as shown in FIG. 3E, the sintered body 34 is worked by burnishing its worked surface which is the inside diameter of the through hole 1*b*, by means of a hole-working burnishing tool 51 (shown in FIG. 19) to cause the worked surface of the through hole 1*b* of the sintered body 34 to retreat so as to enlarge its inner diameter, to densiticate the worked surface portion of the through hole 1*b* of the sintered body 34 by plastic deformation.

In this embodiment, when the through hole 1*b* of the sintered body 34 is worked by finishing its inner periphery as shown in FIG. 3E, the turning making use of the inner-wall finishing tool 38 is changed to the burnishing making use of the hole-working burnishing tool 51.

Figure 19:
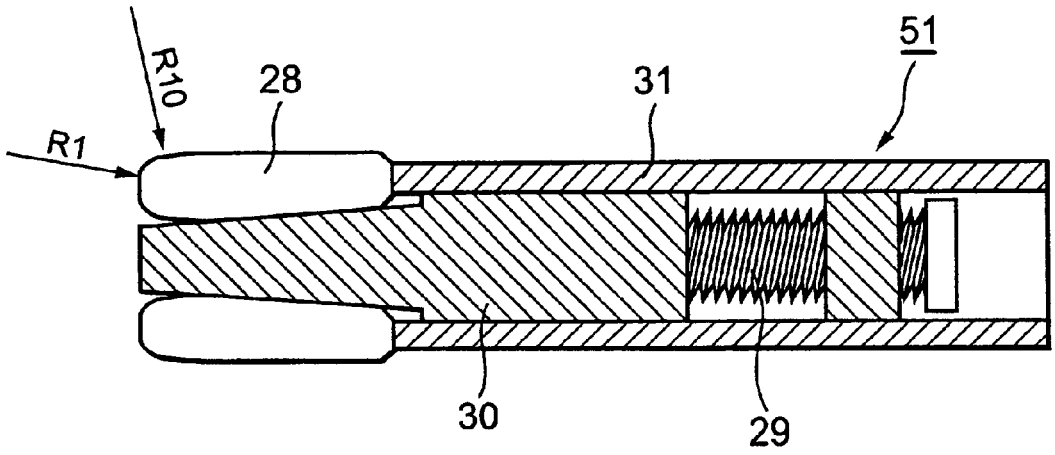
FIG. 19 illustrates a burnishing tool for boring.

The hole-working burnishing tool 51 used here has, as shown in FIG. 19, a frame 31, a mandrel 30 provided movably inside the frame 31, four rollers 28 attached to the mandrel 30 end portion standing out of the frame 31, and an adjusting screw 29 for moving the mandrel 30.

The four rollers 28 of the hole-working burnishing tool 51 are supported by the mandrel 30 inside the frame 31, and are so constructed that the diameter at the part of the four rollers 28 can be adjusted by turning the adjusting screw 29 to move the mandrel 30 forward or backward in the lengthwise direction.

Specific steps for the working are as follows: First, using a drill 37 having diameter smaller by 0.1 to 0.2 mm than the inner diameter of the through hole 1*b*, the sintered stock product is worked to make a prepared hole of the through hole 1*b* of the electrode 1. Thereafter, the hole-working burnishing tool 51, the diameter of which has been so adjusted as to be larger by 0.01 mm than the inner diameter, is rotated at a number of revolutions S of 1,600 rev./min., and inserted into the through hole 1*b* of the electrode 1 at a feed f of 0.4 mm/rev. to carry out the working to finish and burnish the inner periphery of the through hole 1*b* of the electrode 1.

Figure 9:
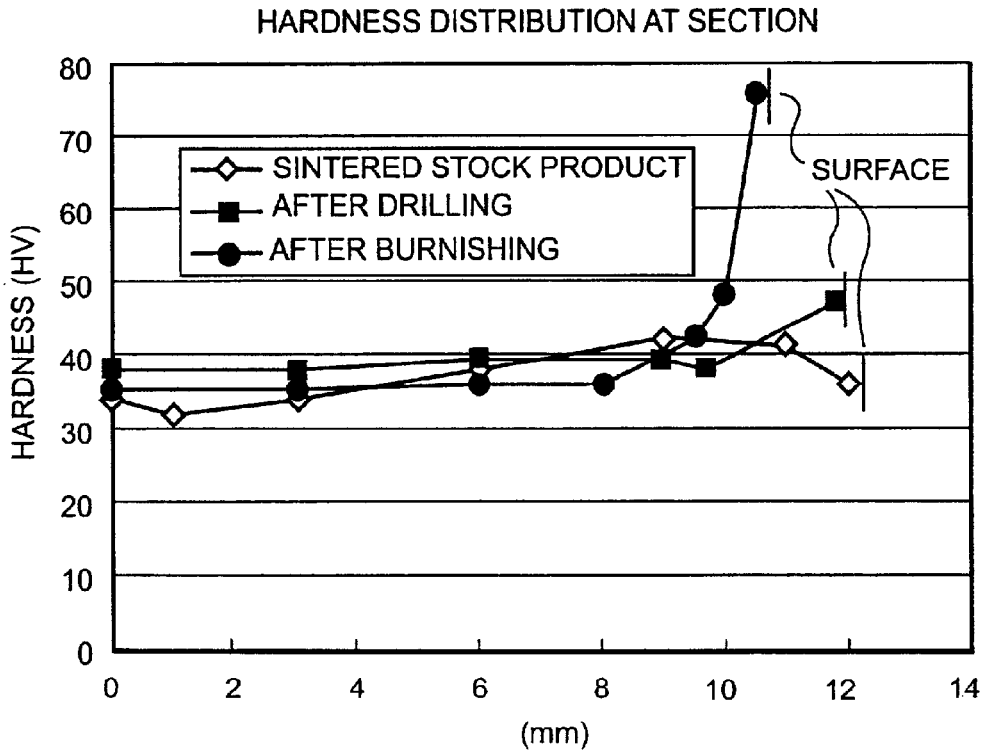
FIG. 9 is a graph showing the distribution of Vickers hardness of a sintered stock product at its section.

Results of measurement of Vickers hardness of the sintered stock product at its section immediately after sintering, after drilling (rough machining) and after burnishing are shown in FIG. 9. Here, the Vickers hardness is measured at interiors of Cu particles.

As can be seen from FIG. 9, the burnishing makes the sintered stock product have a larger density at its part ranging from the arc running surface to a depth of 0.5 mm. As also can be seen from FIG. 9, the hardness of the sintered stock product at its through-hole surface after drilling is only slightly improved, compared with the hardness of the sintered stock product at its middle. On the other hand, the hardness of the sintered stock product at its through-hole surface after burnishing is HV 76, which is greatly improved compared with the hardness HV 36 of the sintered stock product at its interior after burnishing.

In this embodiment, since the surface of the sintered stock product is densicated and hardened by working, the reliability can be improved at the part of connection between the fixed electrode 5 and the fixed conductor 7 and between the movable electrode 6 and the movable conductor 8. The effect attributable to such densitication and hardening is not limited to the conductors as in this embodiment, and is considered to be likewise expectable also in other sintered stock products.

Embodiment 3

In this embodiment, the sintered body 34 the arc running face 4*a* of which can not be worked using a lathe because the grooves 2 are formed in the arc running face 4*a* is worked by burnishing by means of a milling type burnishing tool.

Figure 20:
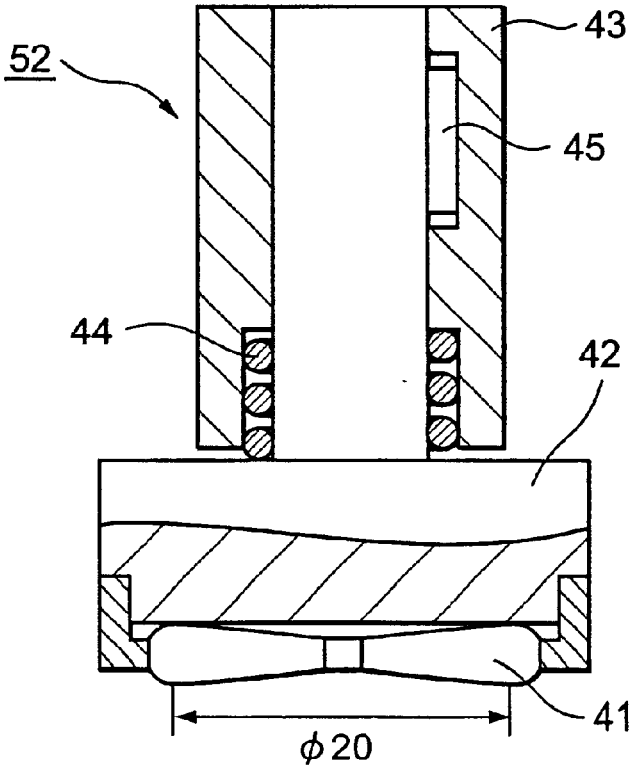
FIG. 20 illustrates a milling type burnishing tool.

As shown in FIG. 20, a milling type burnishing tool 52 used in this embodiment has a roller 41, a mandrel 42 which supports the roller 41, a shaft 43, and a spring 44 held between the shaft 43 and the mandrel 42. This milling type burnishing tool 52 has four rollers 41, and is rotatable in a diameter of 20 mm at the time of burnishing. Also, it is so constructed that a key 45 makes the shaft 43 and the mandrel 42 not mutually rotatable.

In this embodiment, the shaft 43 of the milling type burnishing tool 20 is attached to a machining center, and the arc running face 4*a* of the electrode 1 was densiticated by burnishing under conditions of a number of revolutions S of 750 rev./min. and a feed f of 0.4 mm/rev.

In this embodiment, the grooves 2 are previously formed in the arc running face 4*a* of the sintered body 34. This sintered body 34, which is held and kept rotated, is worked by cutting away an end thereof by means of the cutting tool (cemented carbide lathe cutting tool) 16, followed by burnishing carried out through a tool path such that the relative movement between the sintered body 34 and the burnishing tool 39 is in parallel to the worked surface at an end of the sintered body 34 and also the burnishing tool 39 is brought into contact with the whole worked surface of the sintered body 34 to cause the worked surface of the sintered body 34 to retreat, to densiticate the worked surface portion of the sintered body 34 by plastic deformation.

Figure 21:
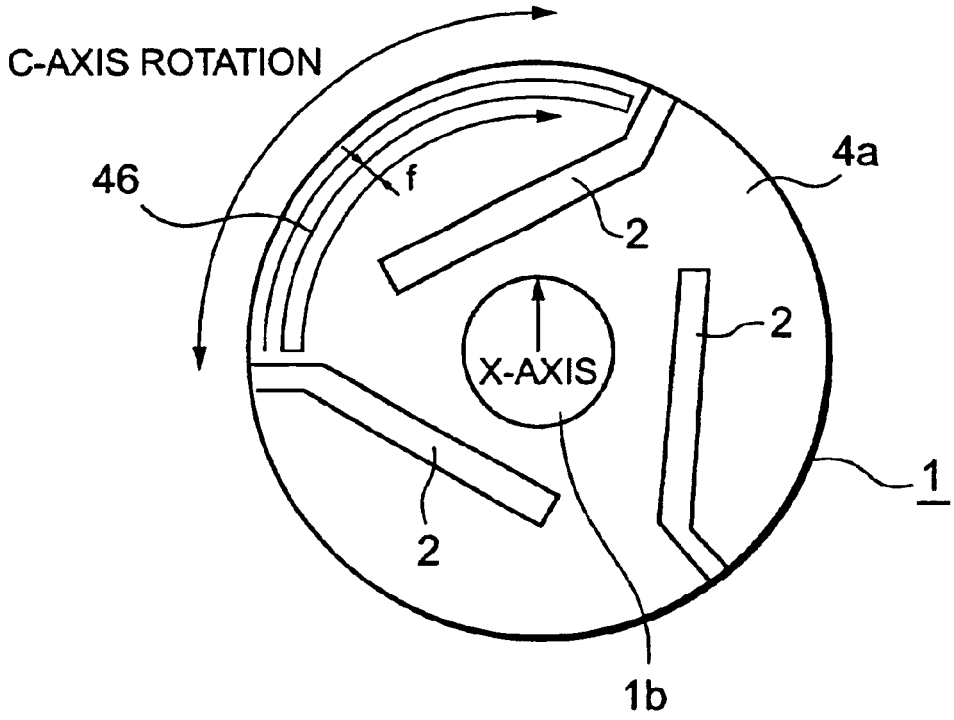
FIG. 21 illustrates a method of working an electrode in Embodiment 3.

In this case, with respect to the electrode 1 attached to a chuck of a turning center for example, the burnishing tool 39 pressed perpendicularly against the arc running face 4*a* of the electrode 1 is moved along a burnishing path 46 as shown in FIG. 21, according to the C-axis rotation of the main shaft and the movement of the burnishing tool 39 in the X-axis direction. Here, the tool path is so set that the burnishing path 46 along which the burnishing tool 39 is moved is at a space f of from 0.05 to 0.3 mm and applies over the whole surface of the arc running face 4*a* of the electrode 1. This has enabled surface densitication of the arc running face 4*a* of the electrode 1.

The extent of retreat of the worked surface as a result of the burnishing carried out on the sintered body 34 in this embodiment is 300 $\mu$m at the maximum.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications a fall within the ambit of the appended claims.

What is claimed is:

1. A vacuum circuit breaker comprising a vacuum vessel and a pair of electrodes positioned in said vessel, wherein said electrodes each comprise an electrode main body formed of the same material as a whole, respectively, and the conductivity of said electrode main body at its part extending from the arc running face to a predetermined depth is higher than a conductivity of the whole electrode main body.

2. The vacuum circuit breaker according to claim 1, wherein the conductivity of said electrode main body at its half on said arc running face side being higher than the conductivity at its half on the back-surface side.

3. The vacuum circuit breaker according to claim 1, wherein:

said predetermined depth is 2 mm; and the conductivity of said electrode main body at its part extending from said arc running face to a depth of 2 mm is at least 1.2 times the conductivity of the whole electrode main body or a conductivity of the electrode main body at its part extending from the back surface thereof to a depth of 2 mm.

4. The vacuum circuit breaker comprising a vacuum vessel and a pair of electrodes positioned in said vessel, wherein said electrodes comprise an electrode main body formed of the same material as a whole, respectively, and a porosity of said electrode main body at its part extending from an arc running face to a predetermined depth is lower than a porosity of the whole electrode main body.

5. The vacuum circuit breaker according to claim 1, wherein the porosity of said electrode main body at its part extending from the arc running face to a predetermined depth is lower than an average porosity of the whole electrode main body.

6. The vacuum circuit breaker according to claim 5, wherein said predetermined depth is 0.5 mm.

7. The vacuum circuit breaker according to claim 1, wherein said electrode main body is provided with a through hole extending from the arc running face to reach the back surface.

8. The vacuum circuit breaker according to claim 4, wherein said electrode main body is provided with a through hole extending from the arc running face to reach the back surface.

9. The vacuum circuit breaker according to claim 1, wherein said arc running face is provided with a groove.

10. The vacuum circuit breaker according to claim 4, wherein said arc running face is provided with a groove.

11. The vacuum circuit breaker according to claim 1, wherein said electrode main body comprises a sintered alloy.

12. The vacuum circuit breaker according to claim 4, wherein said electrode main body comprises a sintered alloy.

13. The vacuum circuit breaker according to claim 1, wherein said electrode main body has an average porosity of from 1 to 10 vol. %.

14. The vacuum circuit breaker according to claim 4, wherein said electrode main body has an average porosity of from 1 to 10 vol. %.

15. The vacuum circuit breaker according to claim 1, wherein said predetermined depth is half the thickness between the arc running surface and the opposite surface of said electrode main body.

16. The vacuum circuit breaker according to claim 4, wherein said predetermined depth is half the thickness between the arc running surface and the opposite surface of said electrode main body.

* * * * *